US010759172B2

(12) United States Patent
Tanioku

(10) Patent No.: US 10,759,172 B2
(45) Date of Patent: Sep. 1, 2020

(54) HEAD CLEANING DEVICE AND LIQUID DISCHARGE APPARATUS

(71) Applicant: Yuichi Tanioku, Kanagawa (JP)

(72) Inventor: Yuichi Tanioku, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/284,332

(22) Filed: Feb. 25, 2019

(65) Prior Publication Data

US 2019/0263127 A1 Aug. 29, 2019

(30) Foreign Application Priority Data

Feb. 27, 2018 (JP) ..... 2018-033011

(51) Int. Cl.
*B41J 2/165* (2006.01)

(52) U.S. Cl.
CPC ..... *B41J 2/16535* (2013.01); *B41J 2/16508* (2013.01); *B41J 2/16544* (2013.01); *B41J 2/16552* (2013.01); *B41J 2002/1655* (2013.01); *B41J 2002/16558* (2013.01)

(58) Field of Classification Search
CPC ..... B41J 2/16508; B41J 2/16535; B41J 2/16538; B41J 2/16541; B41J 2/16544; B41J 2/1655; B41J 2/16552; B41J 2/16555; B41J 2002/1655; B41J 2002/16558
See application file for complete search history.

(56) References Cited

U.S. PATENT DOCUMENTS 5,790,146 A * 8/1998 Anderson ..... B41J 11/007 347/28
2004/0218003 A1* 11/2004 Monclus ..... B41J 2/16508 347/35
2014/0152740 A1* 6/2014 Yoshino ..... B41J 2/16535 347/31
2017/0253044 A1* 9/2017 Ohnishi ..... B41J 2/16505
2018/0126737 A1 5/2018 Asano
2018/0264822 A1 9/2018 Tanioku et al.

FOREIGN PATENT DOCUMENTS

JP 2014-108594 6/2014
JP 2017-056696 3/2017
JP 2017-154361 9/2017

* cited by examiner

*Primary Examiner* — Anh T Vo
(74) *Attorney, Agent, or Firm* — Oblon, McClelland, Maier & Neustadt, L.L.P.

(57) ABSTRACT

A head cleaning device includes a liquid discharge head, a wiping member, a rotatable pressing member, and a moving assembly. The liquid discharge head includes a nozzle, which discharges liquid, on a nozzle surface. The wiping member wipes the nozzle surface. The rotatable pressing member presses the wiping member against the nozzle surface. The moving assembly contacts the wiping member with the nozzle surface and relatively moves the liquid discharge head and the wiping member to perform a wiping operation. The pressing member includes a recess corresponding to a nozzle forming portion of the nozzle surface on a part of a surface of the pressing member.

16 Claims, 9 Drawing Sheets

HEAD CLEANING DEVICE AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-033011, filed on Feb. 27, 2018, in the Japan Patent Office, the entire disclosure of which is incorporated by reference herein.

BACKGROUND

Technical Field

Aspects of the present disclosure relate to a head cleaning device and an liquid discharge apparatus.

Related Art

In general, an inkjet recording apparatus can perform a cleaning operation (suction cleaning) for forcibly suctioning ink from a nozzle of a liquid spray head into a cap and discharging the ink in a capping state where the cap is brought into contact with a nozzle forming surface so as to surround the nozzle of the liquid spray head. When the suction cleaning is repeatedly performed, a nip at a cap front end is gradually contaminated with ink, and the ink attached to the nip of the cap at the time of capping such as the suction cleaning is transferred on the nozzle surface. The ink is dried and thickened to be fixed so as to surround the nozzle of the nozzle surface. As deposition of adhered ink on the nozzle surface is progressed, a conveyance object is scraped with the deposition at the time of printing and an image defect occurs, and a gap is generated between the nozzle surface and the nip of the cap at the time of capping, and moisture retention and suction of the nozzle surface are not normally performed. Therefore, it is necessary to sufficiently remove the adhered ink at the time of wiping the nozzle surface.

As a method for wiping the nozzle surface of the recording head of the inkjet recording apparatus, a method has been known for removing ink on the nozzle surface using a wiping sheet which is provided in the apparatus body and is a wiping member for wipe the ink on the nozzle surface.

SUMMARY

In an aspect of the present disclosure, there is provided a head cleaning device that includes a liquid discharge head, a wiping member, a rotatable pressing member, and a moving assembly. The liquid discharge head includes a nozzle, which discharges liquid, on a nozzle surface. The wiping member wipes the nozzle surface. The rotatable pressing member presses the wiping member against the nozzle surface. The moving assembly contacts the wiping member with the nozzle surface and relatively moves the liquid discharge head and the wiping member to perform a wiping operation. The pressing member includes a recess corresponding to a nozzle forming portion of the nozzle surface on a part of a surface of the pressing member.

In another aspect of the present disclosure, there is provided a head cleaning device that a liquid discharge head, a wiping member, a rotatable pressing member, and a moving assembly. The liquid discharge head includes a nozzle, which discharges liquid, on a nozzle surface. The wiping member wipes the nozzle surface. The rotatable pressing member presses the wiping member against the nozzle surface. The moving assembly contacts the wiping member with the nozzle surface and relatively moves the liquid discharge head and the wiping member to perform a wiping operation. A hardness of a part of a peripheral surface of the pressing member is lower than a hardness of another part of the peripheral surface.

In still another aspect of the present disclosure, there is provided a liquid discharge apparatus including the above-described head cleaning device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
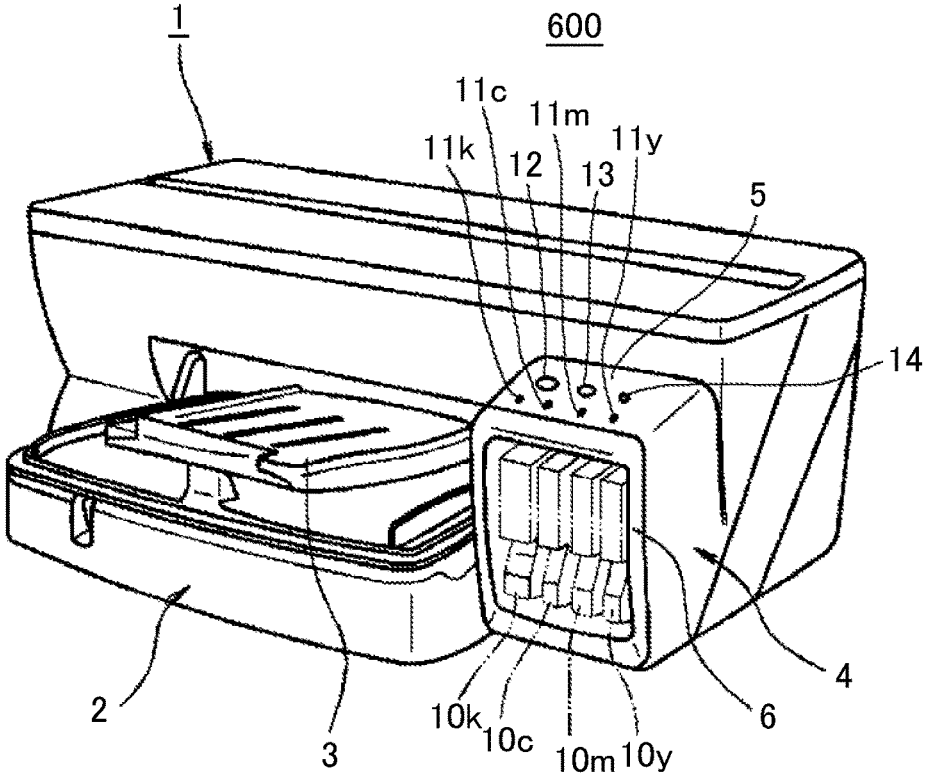
FIG. 1 is a perspective explanatory view of an inkjet recording apparatus viewed from a front side.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 is a perspective explanatory view of an inkjet recording apparatus 600 as an liquid discharge apparatus according to an embodiment of the present disclosure viewed from a front side.

The inkjet recording apparatus 600 includes an apparatus body 1, a supply tray 2 which is mounted in the apparatus body 1 and loads a conveyance object, and an ejection tray 3 which is removably attached to the apparatus body 1 and stocks the conveyance object on which an image is recorded (formed). In addition, on one end portion side of a front surface of the apparatus body 1 (side of supply and ejection tray), a cartridge loading unit 4 to load an ink cartridge is included, and an upper surface of the cartridge loading unit 4 is an operation/display unit 5 in which operation buttons, a display, and the like are provided.

In the cartridge loading unit 4, recording liquid (ink) which is color materials having different colors, for example, ink cartridges (main tank) 10*k*, 10*c*, 10*m*, and 10*y* (referred to as "ink cartridge 10" when colors are not distinguished from each other) which are recording liquid cartridges for storing black (K) ink, cyan (C) ink, magenta (M) ink, and yellow (Y) ink can be inserted to be loaded from the front side toward the rear side of the apparatus body 1. On the front side of the cartridge loading unit 4, a front cover (cartridge cover) 6 which opens when the ink cartridge 10 is attached/detached is openably and closably provided. In addition, the ink cartridges 10*k*, 10*c*, 10*m*, and 10*y* are loaded in a state of being arranged to be vertically placed and aligned in the lateral direction.

In the operation/display unit 5, at arrangement positions corresponding to attaching positions (arrangement position) of the respective ink cartridges 10*k*, 10*c*, 10*m*, and 10*y*, remaining amount display units 11*k*, 11*c*, 11*m*, and 11*y* of the colors to display that the remaining amount of each of the ink cartridges 10*k*, 10*c*, 10*m*, and 10*y* reaches near end or to the end are arranged. In addition, in the operation/display unit 5, a power button 12, a conveyance object feed/print restart button 13, and a cancel button 14 are arranged.

Figure 2:
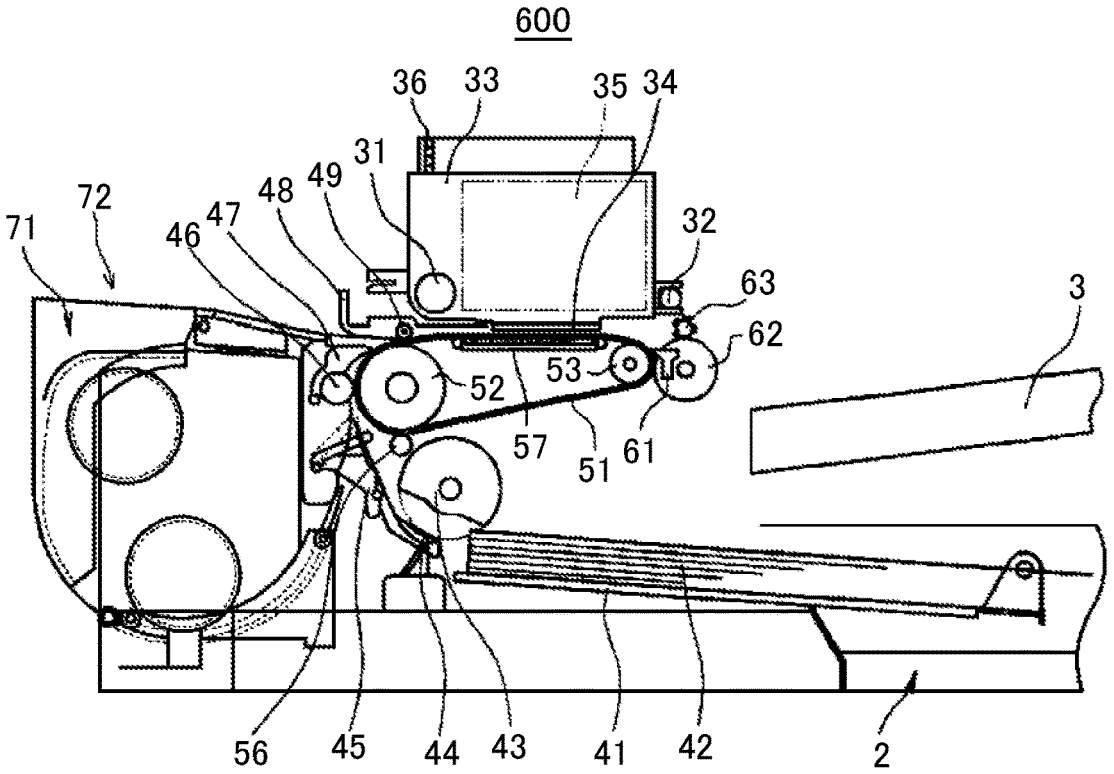
FIG. 2 is a schematic side view for explaining a general arrangement of a mechanical unit of the inkjet recording apparatus.

Next, a mechanical unit of the inkjet recording apparatus 600 will be described with reference to FIGS. 2 and 3. FIG. 2 is a schematic explanatory side view of an outline of the mechanical unit, and FIG. 3 is a plan explanatory view of a main part.

Figure 3:
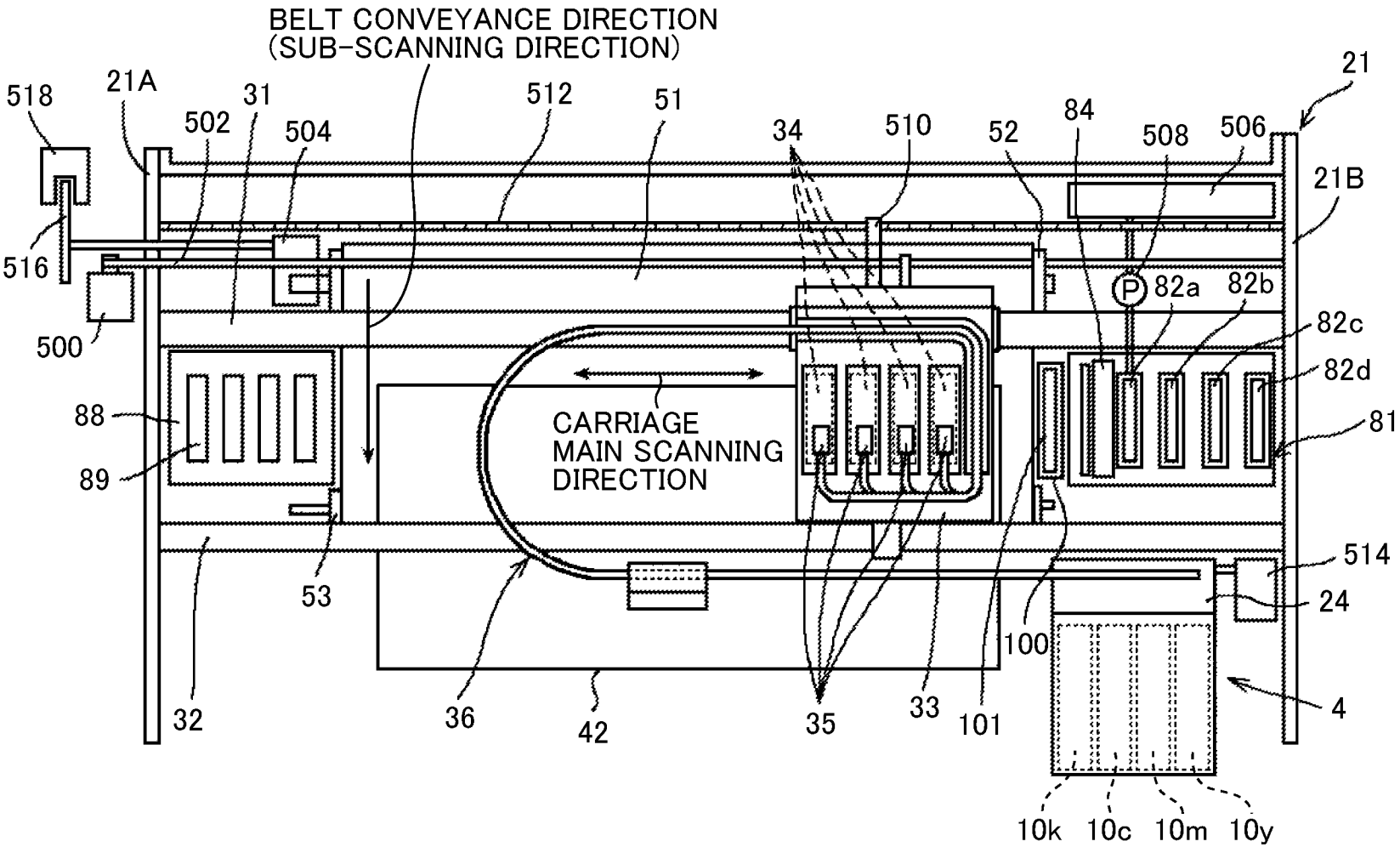
FIG. 3 is a plan explanatory view of a main part of the mechanical unit.

A main guide rod 31 and a guided rod 32 which are main guide members for laterally bridging on right and left side plates 21A and 21B forming a frame 21 slidably hold a carriage 33 in a main scanning direction, and a main scanning motor 500 moves and scans the carriage 33 via a timing belt 502 in an arrow direction in FIG. 3 (carriage main scanning direction).

As described above, on the carriage 33, four recording heads 34 including liquid droplet discharge heads to discharge ink droplets of colors of yellow (Y), cyan (C), magenta (M), and black (Bk) are arranged in a state where a plurality of ink discharge ports is arranged in a direction intersecting with the main-scanning direction (conveyance object conveying direction), and the recording head 34 is attached to the carriage 33 so that the ink droplet is discharged downward. A configuration including a single or a plurality of heads including a row of nozzles to discharge liquid of the respective colors can be employed.

As an inkjet head configuring the recording head 34, an inkjet head including a pressure generator which generates a pressure to discharge the liquid such as a piezoelectric actuator such as a piezoelectric element, a thermal actuator which uses a phase change caused by film boiling of the liquid by using an electrothermal conversion element such as a heating resistor, a shape-memory alloy actuator using a metal phase change caused by a temperature change, and an electrostatic actuator using electrostatic power can be used.

A head tank 35 of each color to supply ink of each color to each recording head 34 is mounted on the carriage 33. As described above, the ink of each color is supplemented and supplied from the ink cartridge 10 of each color attached to the cartridge loading unit 4 to the head tank 35 of each color via a flexible supply tube 36 of each color. In the cartridge loading unit 4, a supply pump 24 which is a liquid supply unit to supply the ink in the ink cartridge 10 is provided.

On the other hand, as a supply unit for supplying a conveyance object 42 stacked on a conveyance object stacking unit (pressure plate) 41 of the supply tray 2, a semicircular roller (supply roller) 43 which separately feeds the conveyance object 42 from the conveyance object stacking unit 41 one by one and a separating pad 44 which faces the supply roller 43 and includes a material with a large coefficient of friction are included, and the separating pad 44 is biased toward the supply roller 43.

To feed the conveyance object 42 supplied from the supply unit below the recording head 34, a guide 45 for guiding the conveyance object 42, a counter roller 46, a conveyance guide member 47, a holding member 48 including a front end pressurizing roller 49 are included, and in addition, a conveyance belt 51 which is a conveyer for electrostatically attracting the fed conveyance object 42 to convey the conveyance object 42 at a position facing the recording head 34 is included.

The conveyance belt 51 is an endless belt and is stretched around a conveyance roller 52 and a tension roller 53 to rotate in a belt conveyance direction (sub-scanning direction). Furthermore, a charging roller 56 which is a charger for charging a surface of the conveyance belt 51 is included. The charging roller 56 is arranged so as to have contact with the surface layer of the conveyance belt 51 and rotate by following the rotation of the conveyance belt 51. In addition, on a rear side of the conveyance belt 51, a guide member 57 is arranged in correspondence with a printing area printed by the recording head 34.

The conveyance roller 52 rotates and drives via a timing by a sub-scanning motor 504 to rotate and move the conveyance belt 51 in the belt conveyance direction in FIG. 3.

In addition, as an ejector to eject the conveyance object 42 recorded by the recording head 34, a separation claw 61 which separates the conveyance object 42 from the conveyance belt 51, an ejection roller 62, and an ejection roller 63 are included, and the ejection tray 3 is provided below the ejection roller 62.

A duplex unit 71 is removably attached to the back surface portion of the apparatus body 1. The duplex unit 71 takes in and inverts the conveyance object 42 which is returned in an against rotation of the conveyance belt 51 and supplies the conveyance object 42 between the counter roller 46 and the conveyance belt 51 again. An upper surface of the duplex unit 71 serves as a manual sheet feeding tray 72.

In addition, as illustrated in FIG. 3, in a non-printing area on one side of the carriage 33 in the scanning direction, a maintenance and recovery mechanism 81 which includes a recovery unit for maintaining and recovering a state of the nozzle of the recording head 34 is arranged.

The maintenance and recovery mechanism 81 includes cap members (referred to as "cap" below) 82*a* to 82*d* (referred to as "cap 82" when not distinguished) for respectively capping the nozzle surfaces of the recording heads 34, an dummy discharge receptacle 84 which receives droplets generated when dummy discharge for discharging droplets which do not contribute to record is performed to discharge thickened recording liquid, and a suction pump 508. Here, the cap 82*a* is used as a suction and moisture cap, and the other caps 82*b* to 82*d* are used as moisture caps.

Waste liquid of the recording liquid generated by a maintenance and recovery operation of the maintenance and recovery mechanism 81, ink discharged to the cap 82, ink dummy-discharged to the dummy discharge receptacle 84 are discharged to and stored in a waste liquid tank 506.

The inkjet recording apparatus 600 includes a wiping unit 100 between the maintenance and recovery mechanism 81 and the conveyance belt 51 in the scanning direction of the carriage 33. The wiping unit 100 makes a cloth-like wiping sheet 101 have contact with the nozzle surface 37 of the recording head 34 to wipe and clean the nozzle surface 37. The wiping unit 100 moves in the sub-scanning direction when wiping the nozzle surface 37 of the recording head 34.

Furthermore, as illustrated in FIG. 3, in a non-printing area on the other side of the carriage 33 in the scanning direction, a dummy discharge receptacle 88 which receives droplets generated when dummy discharge for discharging droplets which do not contribute to record is performed to discharge thickened recording liquid during recording and the like is arranged, and the dummy discharge receptacle 88 includes an opening 89 along a nozzle row direction of the recording heads 34.

In the inkjet recording apparatus 600 configured as described above, the conveyance objects 42 are separated and supplied from the supply tray 2 one by one, and the conveyance object 42 which has been supplied substantially vertically upward is guided by the guide 45, sandwiched between the conveyance belt 51 and the counter roller 46 and conveyed, and in addition, the front end of the conveyance object 42 is guided by the conveyance guide member 47 and pressed against the conveyance belt 51 by the front end pressurizing roller 49, and accordingly, the conveyance direction of the conveyance object 42 is changed by substantially 90°.

At this time, to alternately repeat plus outputs and minus outputs from an alternating current (AC) bias supply unit of the controller provided in the apparatus to the charging roller 56, a charging voltage pattern in which an alternating voltage is applied and the conveyance belt 51 is alternately charged is used, that is, plus and minus voltages are alternately charged in a band shape in the sub-scanning direction which is a rounding direction. When the conveyance object 42 is fed on the conveyance belt 51 which has been alternately charged to plus and minus, the conveyance object 42 is attracted by the conveyance belt 51 and conveyed in the sub-scanning direction according to the rotation movement of the conveyance belt 51.

Therefore, by driving the recording heads 34 according to an image signal while moving the carriage 33, ink droplets are discharged to the stopped conveyance object 42 to record one line, and the next line is recorded after the conveyance object 42 has been conveyed by a predetermined amount. Upon receiving a recording end signal or a signal indicating that the rear end of the conveyance object 42 has reached a recording area, a recording operation is terminated, and the conveyance object 42 is ejected to the ejection tray 3.

Furthermore, the carriage 33 is moved to the side of the maintenance and recovery mechanism 81 when waiting printing (recording), the cap 82 caps the recording head 34, and the nozzle is maintained to be moist so that a discharge failure due to ink drying is prevented. In a state where the cap 82 caps the recording head 34, the recovery operation is performed for suctioning the recording liquid from the nozzle (referred to as "nozzle suction" or "head suction") by the suction pump 508 and discharging the thickened recording liquid and bubbles. In addition, before the start of recording, dummy discharge operation for discharging ink which is not related to recording is performed in the middle of the recording. With this operation, a stable discharging performance of the recording head 34 is maintained.

Figure 4:
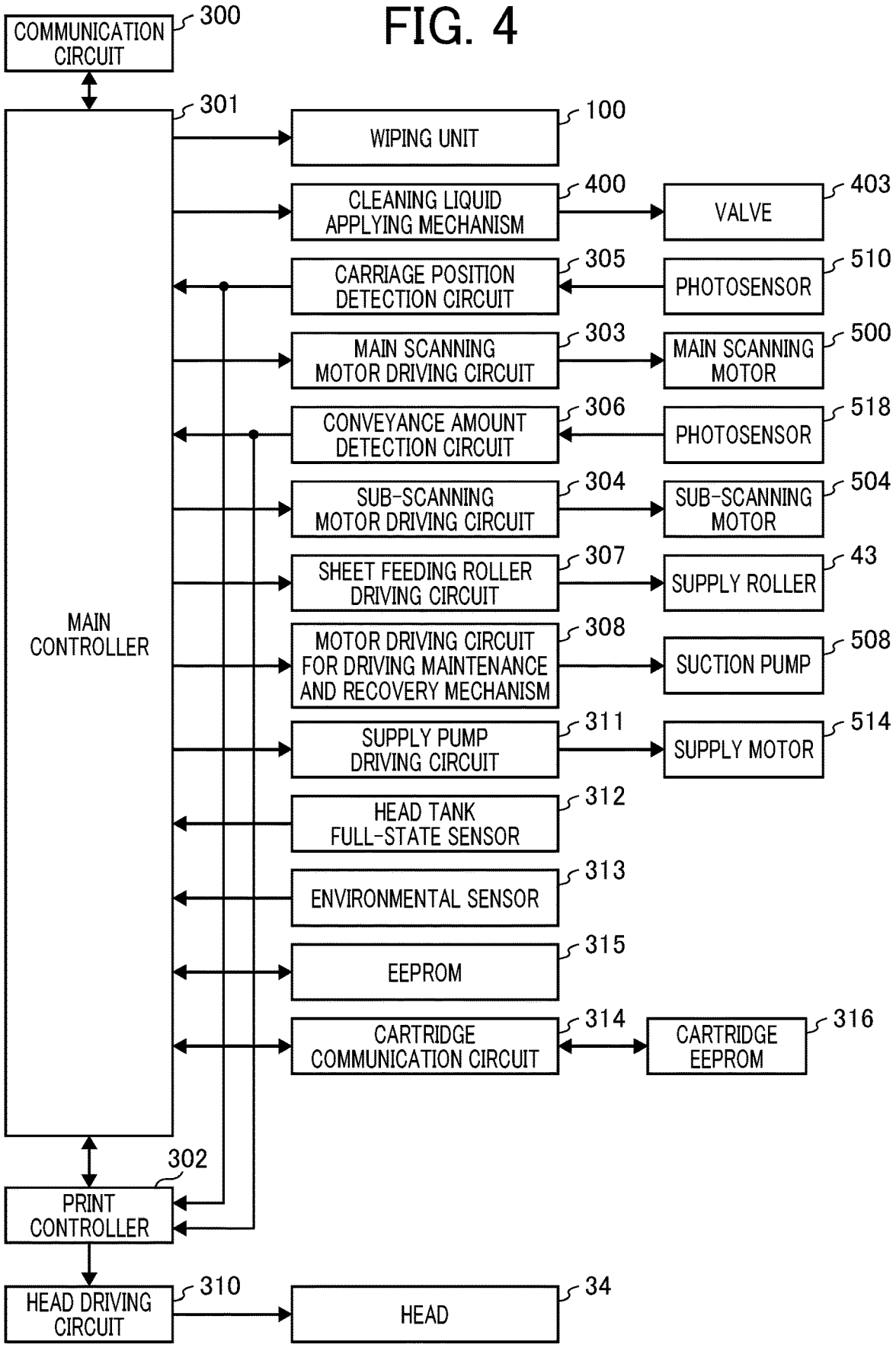
FIG. 4 is a block explanatory diagram of an outline of a controller of the inkjet recording apparatus.

Next, an outline of a controller of the liquid discharge apparatus will be described with reference to FIG. 4. Note that FIG. 4 is a block explanatory diagram of the entire controller.

The controller includes a main controller 301 as circuitry which performs control of the entire liquid discharge apparatus and includes a microcomputer which also functions as a unit for performing control according to an embodiment of the present disclosure and a print controller 302 including a microcomputer which controls printing.

Then, the main controller 301 controls the driving of the main scanning motor 500 for moving the carriage 33 in the main scanning direction via a main scanning motor driving circuit 303 and the sub-scanning motor 504 for feeding the conveyance object 42 via a sub-scanning motor driving circuit 304 to form an image on the conveyance object 42 based on print processing information input from a communication circuit 300 and controls to transmit printing data to the print controller 302.

Furthermore, a detection signal is input from a carriage position detection circuit 305 which detects the position of the carriage 33 to the main controller 301, and the main controller 301 controls a moving position and a moving speed of the carriage 33 based on the detection signal. Furthermore, the main controller 301 controls a moving position and a moving speed of the wiping unit 100 to be described later, a rotation amount of a winding roller 103, a rotation fixing position of a pressing member 104. Furthermore, the main controller 301 controls opening and closing of a valve 403 of a cleaning liquid applicator 400 illustrated in FIG. 9. The carriage position detection circuit 305, for example, reads and counts the number of slits of an encoder sheet 512 arranged along the scanning direction of the carriage 33 by a photosensor 510 mounted on the carriage 33 to detect the position of the carriage 33. The main scanning motor driving circuit 303 rotates and drives the main scanning motor 500 according to a moving amount of the carriage input from the main controller 301 and moves the carriage 33 to a predetermined position at a predetermined speed.

Furthermore, a detection signal is input from a conveyance amount detection circuit 306 which detects a movement amount of the conveyance belt 51 to the main controller 301, and the main controller 301 controls a moving amount and a moving speed of the conveyance belt 51 based on the detection signal. The conveyance amount detection circuit 306, for example, reads and counts the number of slits of a rotation encoder sheet 516 attached to a rotation shaft of the conveyance roller 52 by a photosensor 518 to detect a conveyance amount. The sub-scanning motor driving circuit 304 rotates and drives the sub-scanning motor 504 according to the conveyance amount input from the main controller 301 and rotates and drives the conveyance roller 52 to move the conveyance belt 51 to a predetermined position at a predetermined speed.

The main controller 301 issues a sheet feeding roller driving command to a sheet feeding roller driving circuit 307 to drive the supply roller 43 once. The main controller 301 rotates and drives a motor of the maintenance and recovery mechanism 81 via a motor driving circuit for driving the maintenance and recovery mechanism 308 so as to raise and lower the cap 82 and to drive the suction pump 508 as described above.

The main controller 301 controls the driving of a driving motor (supply motor) 514 for driving a pump of a supply pump 24 via a supply pump driving circuit 311 and supplements and supplies (fills) ink from the ink cartridge 10 loaded to the cartridge loading unit 4 to the head tank 35. At this time, the main controller 301 controls supplement and supply (filling operation) based on a detection signal from a head tank full-state sensor 312 which detects that the head tank 35 is full. In this case, there are atmospheric release filling in which the head tank 35 is filled in a state where an atmospheric release mechanism is opened and normal filling in which the head tank 35 is filled while closing the atmospheric release mechanism.

In addition, the main controller 301 takes in information stored in a non-volatile memory (for example, a cartridge electrically erasable programmable read-only memory (cartridge EEPROM)) 316 which is a storage provided in each ink cartridge 10 attached to the cartridge loading unit 4 via a cartridge communication circuit 314, performs predetermined processing, and stores and holds the information in a non-volatile memory (for example, an EEPROM) 315 which is a main body storage.

In addition, a detection signal from an environmental sensor 313 which detects an environmental temperature and an environmental humidity is input to the main controller 301.

The print controller 302 generates data to drive the pressure generator for discharging the droplets of the recording head 34 based on the signal from the main controller 301 and the position and the conveyance amount of the carriage from the carriage position detection circuit 305, the conveyance amount detection circuit 306, and the like. Furthermore, the print controller 302 transfers the image data described above as serial data to a head driving circuit 310 and outputs a transfer clock and a latch signal necessary for transferring the image data, determining the transfer, and the like, a droplet control signal (mask signal), and the like to the head driving circuit 310. Furthermore, the print controller 302 includes a digital to analog (D/A) converter which D/A converts pattern data of a driving signal stored in a ROM, a driving waveform generation unit including a voltage amplifier, a current amplifier, and the like, and a driving waveform selection unit which selects a driving waveform to be applied to a head driver. Then, the print controller 302 generates a driving waveform including a single driving pulse (driving signal) or a plurality of driving pulses (driving signal) and outputs the generated signal to the head driving circuit 310.

The head driving circuit 310 applies a driving signal forming the driving waveform applied from the print controller 302 to a driving element (for example, piezoelectric element described above) which generates energy for selectively discharge the droplets of the recording head 34 based on image data corresponding to one line of the recording head 34 which is serially input to drive the recording head 34. At this time, by selecting the driving pulse forming the driving waveform, for example, it is possible to separately record dots with different sizes, for example, a large droplet (large dot), a medium droplet (medium dot), and a small droplet (small dot).

Next, an example of the present embodiment will be described in detail.

First, a deposition mechanism of adhered ink from the cap 82 to the nozzle surface 37 will be described with reference to FIGS. 5A to 5E and 6. In FIGS. 5A to 5E, description will be made as assuming that the cap 82 move toward the recording head 34. However, either one of the cap 82 or the recording head 34 may move. Furthermore, under the cap 82, the suction pump 508 for suctioning ink from a nozzle 38 of the recording head 34 is arranged.

Figure 5A:
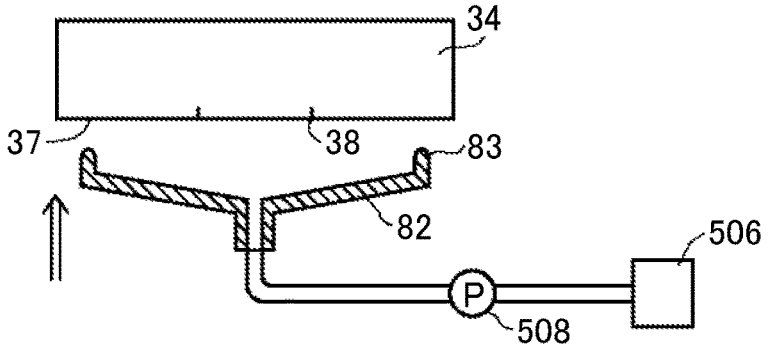
FIGS. 5A to 5E are diagrams of a deposition mechanism of adhered ink from a cap to a nozzle surface.
Figure 5B:
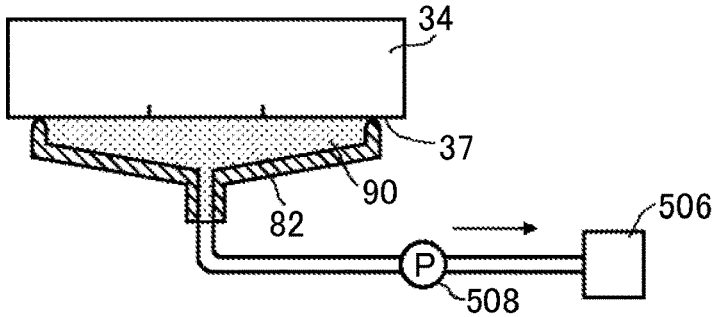
Figure 5C:
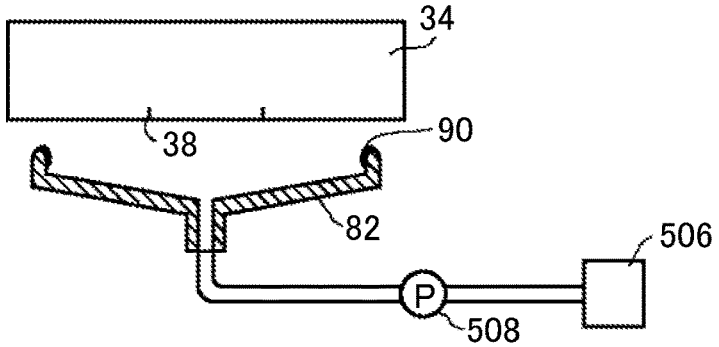
Figure 5D:
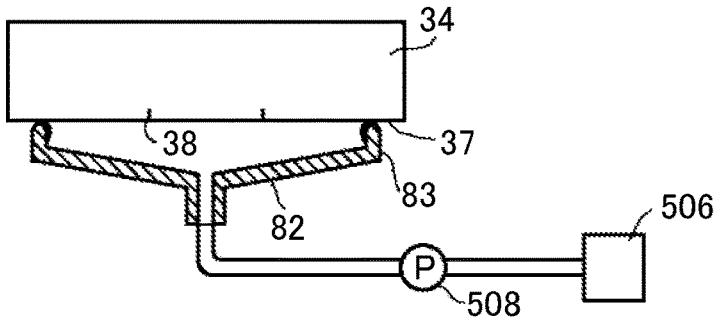
Figure 5E:
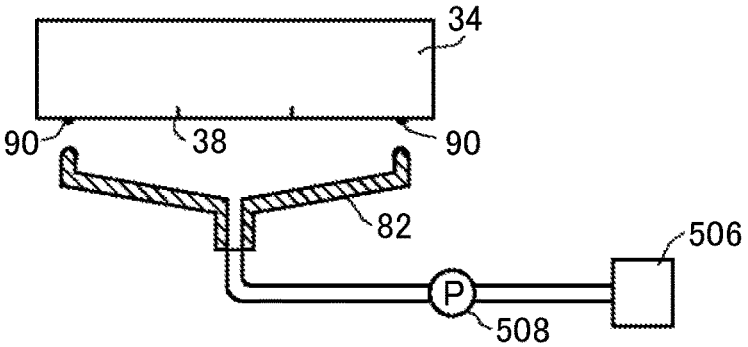

At the time of maintenance and recovery operation (maintenance) of the recording head, after the cap 82 away from the nozzle surface 37 of the recording head 34 is raised, has contact with the nozzle surface 37, and performs capping (FIG. 5A), ink 90 is suctioned from the nozzle 38 by the suction pump 508 (FIG. 5B). Next, after the cap 82 has moved down to a position away from the nozzle surface 37 and the nozzle surface 37 has been wiped by the wiping sheet 101, the ink 90 in the cap is discharged (FIG. 5C). After the ink 90 is discharged, the ink 90 is attached to a nip 83 which is a part of the cap 82 having contact with the nozzle surface 37. If capping is performed in this state, the ink 90 has contact with the nozzle surface 37 again (FIG. 5D), and the ink 90 is transferred on the nozzle surface 37 after the cap 82 has been separated from the nozzle surface 37 (FIG. 5E).

Figure 6:
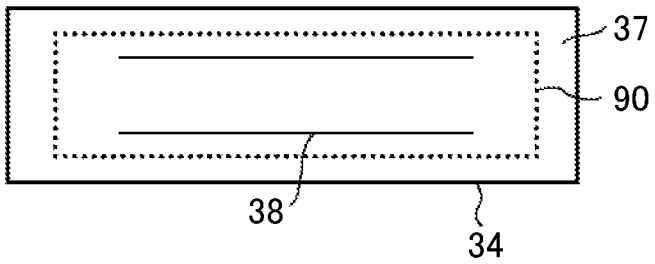
FIG. 6 is a diagram of the deposition mechanism of the adhered ink from the cap to the nozzle surface 37.

With the deposition mechanism described above, the ink 90 is attached on the nozzle surface 37 so as to surround the nozzle 38 (FIG. 6). FIG. 6 is a bottom view of the recording head 34, and it can be seen that the ink 90 is deposited on the nozzle surface 37 in a rectangular shape. This is because the nip 83 of the cap 82 has a rectangular shape so as to surround the nozzle 38. However, the shape of the nip 83 is not limited to a rectangle and may have another shape.

Next, a wiping unit according to an embodiment of the present disclosure will be described with reference to FIG. 7.

The wiping unit 100 wipes the ink 90, a foreign matter, and the like attached on the nozzle surface 37 of the recording head 34 by the wiping sheet 101 at the time of maintenance.

The wiping unit 100 includes the wiping sheet 101 which is a planar and roll-shaped wiping member to wipe the nozzle surface 37 of the recording head 34, a supply roller 102 which supplies the wiping sheet 101, the pressing member 104 which presses the wiping sheet 101 against the nozzle surface 37, the winding roller 103 which is a winding member for winding the supplied wiping sheet 101, a compression spring 106 which presses the pressing member 104, a base 105 for fixing the compression spring, and the like. A width of the wiping sheet 101 perpendicular to a wiping direction is set so as to wipe the nozzle surface 37 of the recording head 34 at one time. The pressing member 104 is coupled to the base 105 with the compression spring 106 so as to be pressed against the nozzle surface 37 of the recording head 34 with a constant pressure. The recording head 34 and the wiping unit 100 can be relatively moved to each other. The inkjet recording apparatus 600 includes the recording head 34 including the nozzle 38 for discharging the ink which is a droplet, the cap 82 including the nip 83 which can be abut on the recording head 34 so as to surround the nozzle 38, and the wiping unit 100.

It is preferable to provide an elastic member such as rubber on the surface of the pressing member 104 so as not to damage the nozzle surface 37 of the recording head 34. Furthermore, the pressing member 104 is a rotatable roller member.

The inkjet recording apparatus 600 includes a moving assembly 530 as a mover to move the wiping unit 100 in the sub-scanning direction. The moving assembly 530 is connected to a connection portion 532 of the wiping unit 100 and includes a belt 520 stretched around rollers 526 and a motor 524 for driving the roller 526. By rotating and driving the roller 526 by driving the motor 524, the belt 520 and the wiping unit 100 connected to the belt 520 are moved in the sub-scanning direction.

The wiping unit 100 has contact with a cam 534 via an engaging portion 536. By rotating and driving the cam 534, the wiping unit 100 can be vertically moved.

A rotary encoder 109 is attached to the winding roller 103, and a photosensor 107 of the rotary encoder 109 can measure a wound distance of the wiping sheet 101. The wiping unit 100 includes a driving motor 108 which rotates and drives the winding roller 103, and the main controller 301 controls a rotation speed of the driving motor 108.

Figure 7:
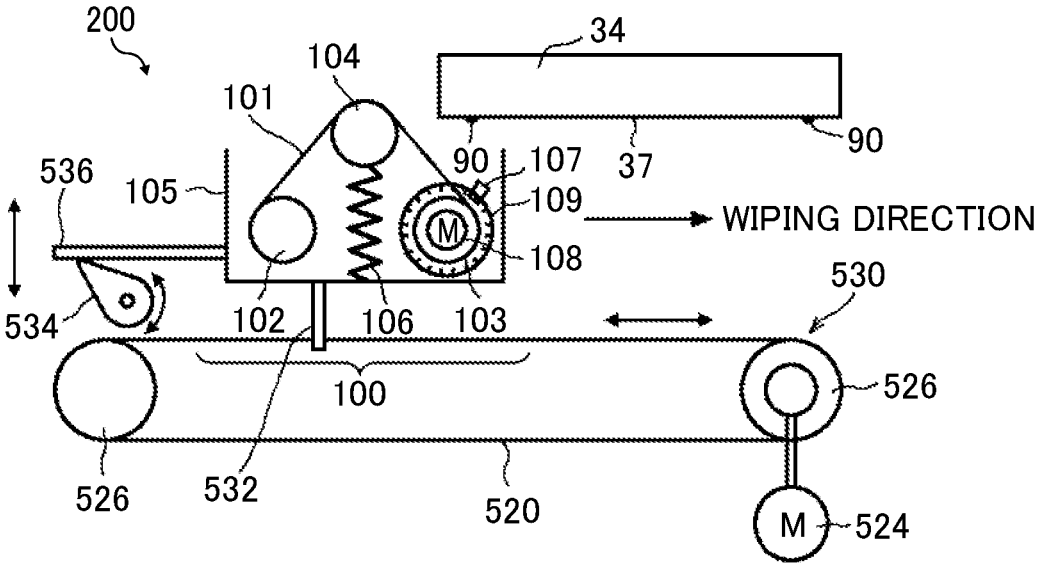
FIG. 7 is a diagram of a wiping unit according to an embodiment of the present disclosure.

In FIG. 7, a head cleaning device 200 according to an embodiment of the present disclosure includes the recording head 34 as a liquid discharge head having the nozzle 38 to discharge liquid on the nozzle surface 37, the wiping sheet 101 as a wiping member which wipes the nozzle surface 37, the rotatable pressing member 104 which presses the wiping sheet 101 against the nozzle surface 37, the main controller 301 as circuitry which rotates the pressing member 104 and fixes the pressing member 104 at an arbitrary position, and the moving assembly 530 as a mover to contact the wiping sheet 101 with the nozzle surface 37 and perform the wiping operation for relatively moving the recording head 34 and the wiping sheet 101. As will be described later, the pressing member 104 includes a recess 115 corresponding to a nozzle forming portion of the nozzle surface 37 on a part of the surface of the pressing member 104 or a hardness of a part of a peripheral surface of the pressing member 104 is lower than a hardness of other parts of the peripheral surface.

Next, the wiping operation of the wiping unit 100 will be described with reference to FIGS. 8A to 8D.

Here, first, a wiping operation in a case where the adhered ink is deposited on the nozzle surface 37 so as to surround the nozzle 38 of the nozzle surface 37 by the transfer from the nip 83 will be described with reference to FIGS. 8A to 8D. An upper view of FIG. 8A is a bottom view of the recording head 34, and a side view of the recording head 34 and the wiping unit 100 is illustrated below the upper view of FIG. 8A.

Figure 8A:
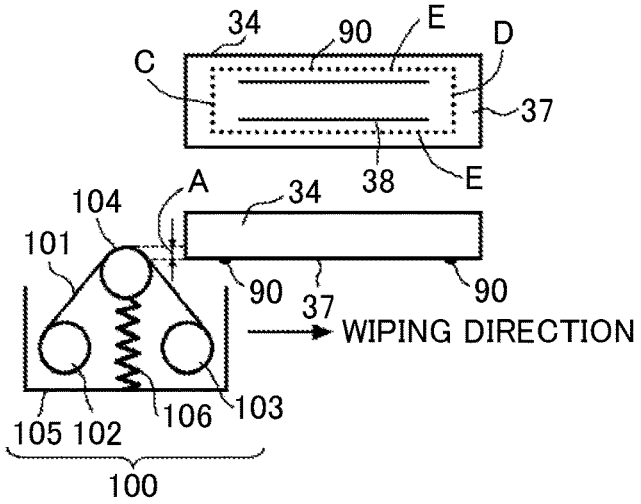
FIGS. 8A to 8D are diagrams of a wiping operation of the wiping unit.

After the wiping operation has been requested, under the control of the main controller 301 (FIG. 4), the wiping unit 100 is raised until the upper end of the pressing member 104 is positioned to be upper than the nozzle surface 37 of the recording head 34 to be wiped (FIG. 8A). A vertical distance A between a height position of the upper end of the pressing member 104 and a height position of the nozzle surface of the recording head 34 is equal to a contraction amount of the compression spring 106 which couples the pressing member 104 at the time of wiping the nozzle surface with the base 105. Therefore, it is necessary for the vertical distance A to be a raise amount to obtain a desired pressing pressure. Furthermore, by changing a spring constant or a natural length of the compression spring 106, it is possible to wipe the nozzle surface 37 of the recording head 34 by the wiping sheet 101 by an arbitrary pressing load. At this time, the recording head 34 and the wiping unit 100 are relatively moved in a state where the winding roller 103 is fixed to wipe the nozzle surface 37 of the recording head 34.

Figure 8B:
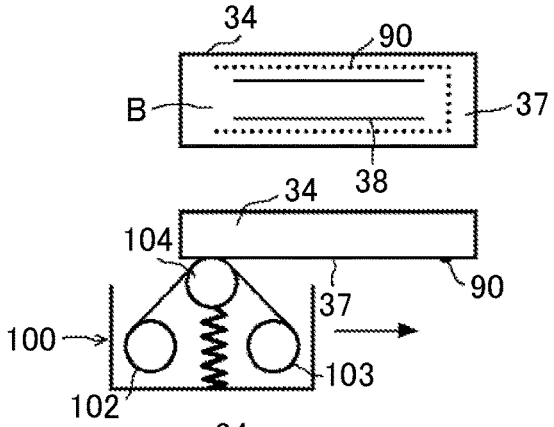
Figure 8C:
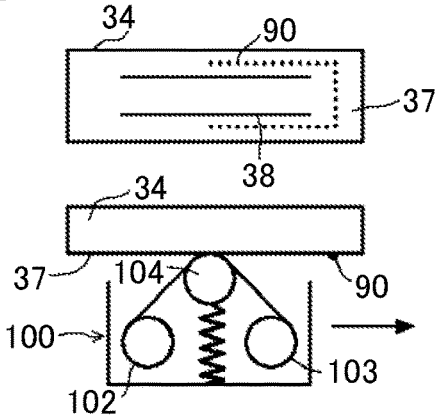
Figure 8D:
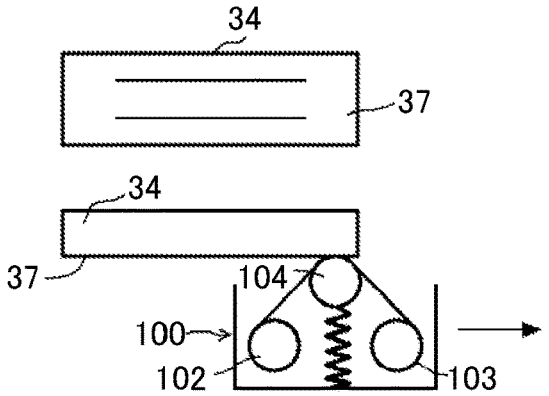

Specifically, by moving the wiping unit 100 in the sub-scanning direction in a state where the wiping sheet 101 has contact with and is pressed against the nozzle surface 37 of the recording head 34, the nozzle surface 37 is wiped by the wiping sheet 101 (FIG. 8B). At this point, a short side position B perpendicular to the wiping direction of the adhered ink 90 surrounding the nozzle 38 has been already wiped.

Thereafter, the wiping operation and the relative movement are continued for a while in a state where the winding roller 103 is fixed (FIG. 8C), and the adhered ink on the two sides along the long side which are attached on both sides of two lines of the nozzles 38 of the rectangular adhered ink 90 attached on the nozzle surface 37 is wiped by the wiping sheet 101.

In addition, the wiping operation and the relative movement are continued for a while in a state where the winding roller 103 is fixed (FIG. 8D), and the adhered ink on the two sides along the long side which are attached on both sides of two lines of the nozzles 38 and the short side position D perpendicular to the wiping direction of the rectangular adhered ink 90 attached on the nozzle surface 37 are wiped by the wiping sheet 101.

At this point, the entire adhered ink surrounding the nozzle 38 has been already wiped. Finally, by lowering the wiping unit 100 and returning relative positions of the recording head 34 and the wiping unit 100 to the original positions, the wiping operation is completed.

Next, the cleaning liquid applicator according to an embodiment of the present disclosure will be described with reference to FIG. 9.

In addition to the wiping unit 100, the head cleaning device 200 according to the present embodiment includes the cleaning liquid applicator 400 which applies cleaning liquid 401 to the supplied wiping sheet 101. The cleaning liquid applicator 400 includes the cleaning liquid 401 stored in a storage tank 402, a nozzle 404 which extends from the storage tank 402 to above the pressing member 104, the valve 403 provided in the nozzle 404, and the like. The valve 403 is opened and closed in response to a request from the main controller 301 (FIG. 4) to drop the cleaning liquid 401 on the wiping sheet 101 via the nozzle 404. The front end of the nozzle 404 is positioned at an upper position so as not to have contact with the wiping sheet 101.

Solution having high volatility is used for the cleaning liquid 401, and the solution can effectively remove the ink 90 and foreign matters attached on the nozzle surface 37 of the recording head 34. It is preferably to use solution having an action for dissolving ink as the cleaning liquid 401. It is desirable that the cleaning liquid 401 is covered with a cover and the like so that the cleaning liquid 401 having high volatility does not come into contact with atmosphere. If a state where the cleaning liquid 401 is hardly volatilized by covering the cleaning liquid 401 with the cover is maintained, it is not necessary to provide the cleaning liquid applicator 400 in the inkjet recording apparatus 600 or the wiping unit 100, and it is preferable that the cleaning liquid 401 be impregnated into the wiping sheet 101 before the wiping sheet 101 is set in the wiping unit 100.

By the cleaning liquid applicator 400 or impregnating the wiping sheet 101 with the cleaning liquid 401 in advance, the nozzle surface 37 can be wet-wiped by using the cleaning liquid 401 with the wiping sheet 101. Therefore, by wiping the nozzle surface 37 in a state where the cleaning liquid is applied to the wiping sheet 101, the adhered ink 90 attached on the nozzle surface 37 can be more efficiently removed.

Figure 9:
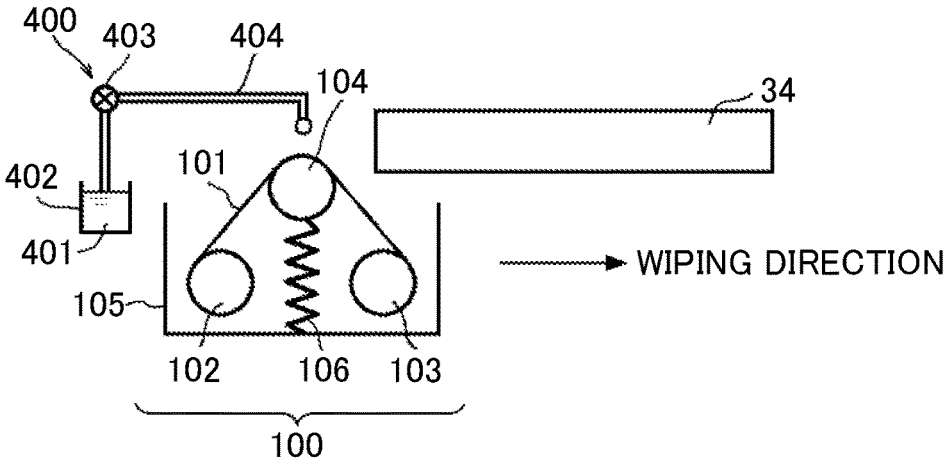
FIG. 9 is a diagram of a cleaning liquid applicator according to an embodiment of the present disclosure.

In a case where the cleaning liquid applicator 400 is provided in the head cleaning device 200 or the inkjet recording apparatus 600 as illustrated in FIG. 9, a configuration is preferable in which the cleaning liquid applicator 400 is fixed at a position which does not prevent the movement of the wiping unit 100 above the wiping unit 100 and the cleaning liquid 401 is dripped on the wiping sheet 101 from the nozzle 404 to apply the cleaning liquid 401 to the wiping sheet 101. A timing when the cleaning liquid 401 is applied to the wiping sheet 101 is preferably immediately before the wiping unit 100 performs the wiping operation. Furthermore, it is preferable that a range in which the cleaning liquid 401 is applied to the wiping sheet 101 be an entire area of the wiping sheet 101 to be used in the following wiping operation. Therefore, in a case where the relative positions of the wiping unit 100 and the cleaning liquid applicator 400 are fixed, in an application process of the cleaning liquid 401 to the wiping sheet 101, it is necessary to apply an amount of the cleaning liquid 401 enough for wet the entire area to be used in the following wiping operation. Alternatively, by relatively moving the wiping unit 100 and the cleaning liquid applicator 400 when the cleaning liquid 401 is applied to the wiping sheet 101, cleaning liquid may be applied to the entire area to be used in the following wiping operation. Furthermore, as a unit for controlling the amount of the cleaning liquid to be applied to the wiping sheet 101, a method is preferable for controlling an opening time of the openable/closable valve 403 provided in the cleaning liquid applicator 400 by the main controller 301 (FIG. 4) as described above. Alternatively, in a case where an electric pump and the like is used to apply the cleaning liquid 401, an apply voltage may be controlled.

Figure 10A:
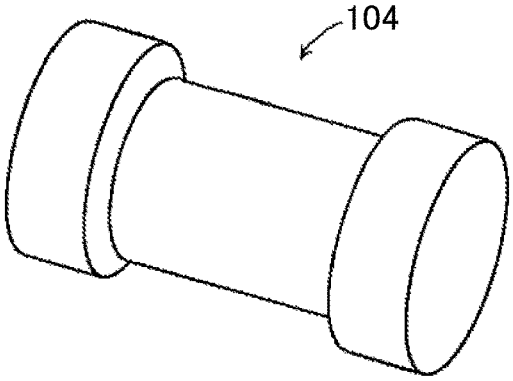
FIGS. 10A and 10B are diagrams of a comparative example of a pressing member.
Figure 10B:
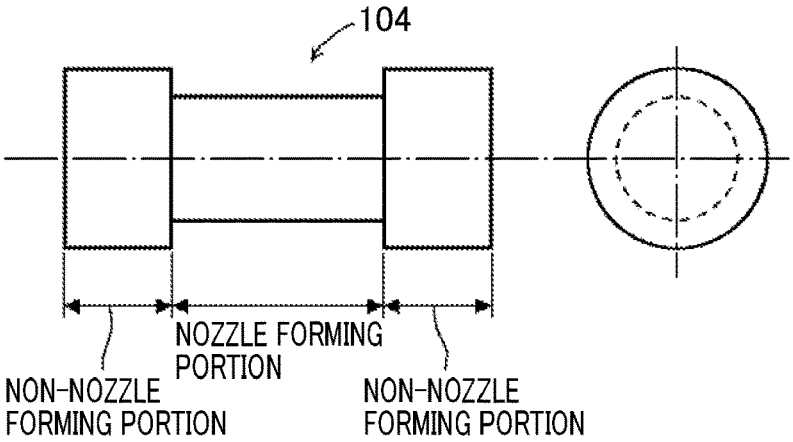
Figure 11A:
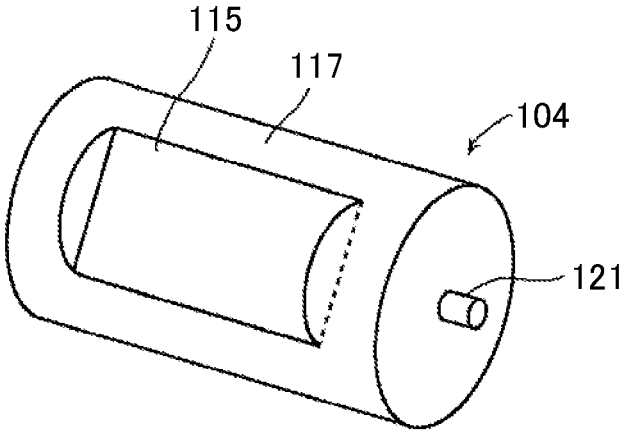
FIGS. 11A and 11B are diagrams of a pressing member according to a first embodiment of the present disclosure.
Figure 11B:
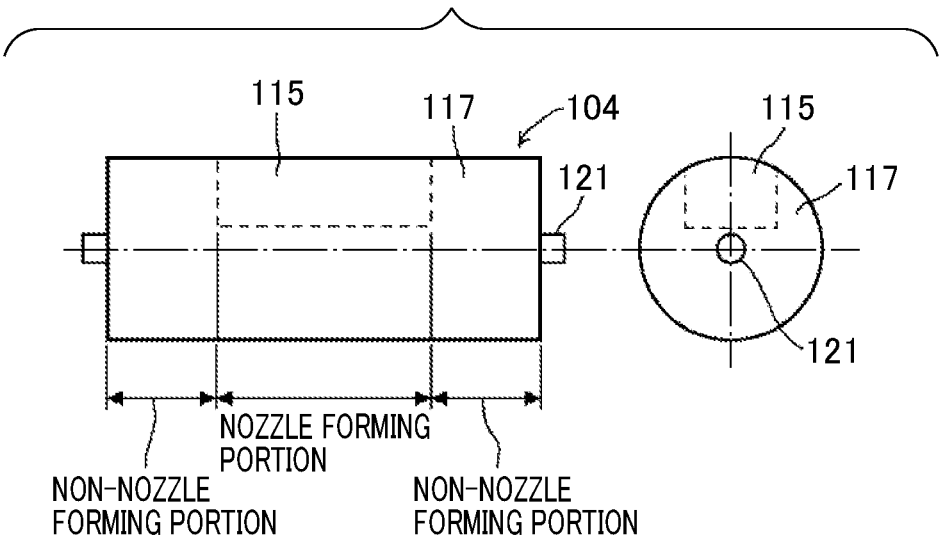
Figure 12A:
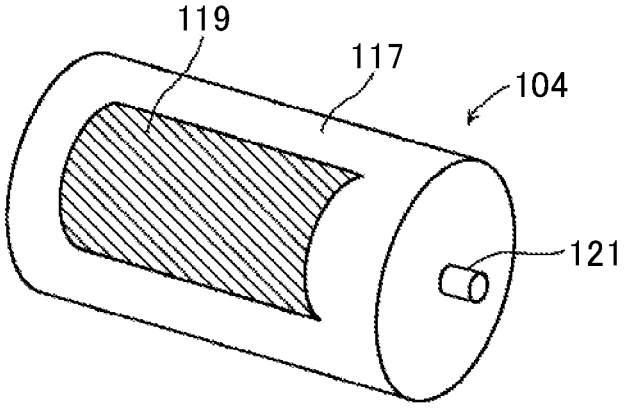
FIGS. 12A and 12B are diagrams of a pressing member according to a second embodiment of the present disclosure.
Figure 12B:
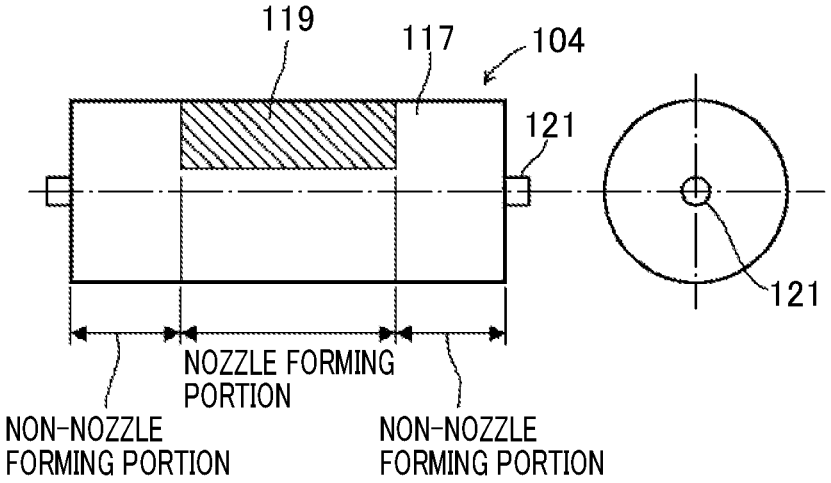

Next, a method for selectively changing a pressure acting on the nozzle surface at the time of wiping the nozzle surface will be described with reference to FIGS. 10A to 12B. FIG. 10A is a schematic perspective view of a comparative example of a pressing member, and FIG. 10B is a schematic side view of the comparative example of the pressing member. FIG. 11A is a schematic perspective view of a pressing member according to a first embodiment of the present disclosure, and FIG. 11B is a schematic side view of the pressing member. FIG. 12A is a schematic perspective view of a pressing member according to a second embodiment of the present disclosure, and FIG. 12B is a schematic side view of the pressing member.

A first method is to change the shape of the pressing member 104 as illustrated in FIGS. 10A to 11B. As described above, the wiping sheet 101 is pressed against the nozzle surface 37 by the pressing member 104 illustrated in FIGS. 11A and 11B, and the ink 90 attached on the nozzle surface 37 is removed.

As illustrated in FIGS. 10A and 10B, in the comparative example of the pressing member 104, a diameter of the pressing member at a position facing a nozzle forming portion of the nozzle surface is smaller than a non-nozzle forming portion on the outer side of the nozzle forming portion. With this structure, at the time of wiping the nozzle surface, a pressure acting on the nozzle forming portion from the wiping sheet is reduced. Therefore, the ink attached to the nozzle forming portion is more hardly removed than the other parts.

On the other hand, according to the first embodiment, as illustrated in FIGS. 11A and 11B, a part of the surface of the pressing member 104 has a recess 115 corresponding to the width of the nozzle forming portion of the nozzle surface 37. In other words, the surface of the pressing member 104 at the position facing the nozzle forming portion of the nozzle surface 37 is locally formed in a recess-like shape (only a part in circumferential direction). On the nozzle surface 37, the two rows of nozzles 38 on the nozzle surface 37 are positioned in the range of the nozzle forming portion, and the non-nozzle forming portion is positioned outside the nozzles 38. A part of the pressing member 104 in the circumferential direction other than the recess 115 is formed as a projection 117. In this example, since the pressing member 104 has a cylindrical shape, the shape of the projection 117 corresponds to the side surface of the cylinder. Therefore, a pressure generated when the wiping sheet 101 is pressed against the nozzle surface 37 by the projection 117 is larger than a pressure generated when the wiping sheet 101 is pressed against the nozzle surface 37 by the recess 115. As a material of the pressing member 104, an elastic member such as resin and rubber can be used.

Furthermore, the pressing member 104 is rotatable, and the pressing member 104 is rotated by power transmission from the driving motor 108 which is controlled by the main controller 301 and is fixed at an arbitrary position. The pressing member 104 is supported with respect to the moving assembly 530 by a shaft 121. Therefore, the rotation fixing position of the pressing member 104 is changed so that the pressure acting on the nozzle surface 37 from the wiping sheet 101 can be selectively changed. For example, in a case where the nozzle forming portion is further worn and water repellency is deteriorated, by changing the rotation fixing position of the pressing member 104 and pressing the wiping sheet 101 against the nozzle surface 37 by using the projection 117 of the pressing member 104 to wipe the nozzle surface 37, it is possible to sufficiently remove the ink attached to the nozzle forming portion and the non-nozzle forming portion of the nozzle surface 37. In a case where the nozzle forming portion is not worn (for example, when recording head 34 is new), by changing the rotation fixing position of the pressing member 104 and pressing the wiping sheet 101 against the nozzle surface 37 by using the recess 115 of the pressing member 104 to wipe the nozzle surface 37, it is possible to remove the ink attached to the nozzle forming portion of the nozzle surface 37 using a weak pressure. The degree of the wear of the nozzle forming portion may be determined by the main controller 301, for example, based on the number of wipes of the recording head 34 and an elapsed time after exchanging the recording head 34. In this way, the main controller 301 changes the rotation fixing position of the pressing member 104 according to the degree of the wear of the nozzle forming portion.

Even in a case where the recess 115 is used, the non-nozzle forming portion of the nozzle surface 37 is wiped by the projection 117. In addition, for example, after several times of wiping operations using the recess 115, the main controller 301 may perform the wiping operation using the projection 117 once. With this operation, normal discharge of the nozzle surface can be maintained without excessively wearing the nozzle surface 37.

As described above, since the surface of the pressing member 104 locally has the recess 115 and the projection 117 and can be rotated to an arbitrary position and can be fixed, the position of the pressing member 104 facing the nozzle surface 37 can be by rotation so that the pressure acting on the nozzle surface 37 can be selectively changed by changing. Therefore, by selectively changing the wiping pressure acting on the nozzle forming portion and wipes the nozzle forming portion with an appropriate pressure, normal ink discharge can be maintained. In a case where it is desired to sufficiently remove the ink attached to the nozzle forming portion, the pressing member 104 is rotated, the projection 117 is used, and the pressure acting on the nozzle forming portion is temporarily increased so that the residual ink on the nozzle forming portion can be reduced.

A pressure which acts on the nozzle surface 37 from the wiping sheet 101 and is generated by the recess 115 of the pressing member 104 is smaller than a pressure which acts on the nozzle surface 37 from the wiping sheet 101 and is generated by the projection 117 other than the recess 115. Accordingly, deterioration of the nozzle forming surface caused by wiping by the wiping sheet 101 can be prevented, and normal ink discharge can be maintained.

In the first embodiment illustrated in FIGS. 11A and 11B, the recess 115 is formed in a part of the surface of the pressing member 104 in the circumferential direction (one location). However, by providing a plurality of recesses 115 in the circumferential direction and the width direction of the pressing member 104, it is possible that the rotation fixing position of the pressing member 104 is changed to adjust the pressure acting on the nozzle surface 37 in multiple stages. For example, the recesses 115 having different depths are formed at three positions in the circumferential direction of the pressing member 104 and the recesses 115 are used so that the three different pressures can be applied on the nozzle surface 37. Here, the depth of the recess corresponds to the height from the side surface (projection 117) of the pressing member 104 to the bottom portion of the recess.

A second method is to change the hardness (elasticity) of the pressing member 104 as illustrated in FIGS. 12A and 12B. In the pressing member 104 according to the second embodiment illustrated in FIGS. 12A and 12B, the hardness of a part of the peripheral surface of the pressing member 104 is lower than the hardness of the other parts of the peripheral surface. In other words, the material of the pressing member 104 at a position facing the nozzle forming portion of the nozzle surface 37 locally (only a part in circumferential direction) includes a material with a smaller hardness. Specifically, as the material of the pressing member 104, an elastic member such as resin and rubber is used. On a part of the pressing member 104 in the circumferential direction and the width direction, an elastic member 119 such as rubber having a hardness smaller than that of the material of the pressing member 104 is provided. For example, the elastic member 119 may be provided on the recess 115 (FIGS. 11A and 11B) in a part of the surface of the pressing member 104 in the circumferential direction. The surface of the elastic member 119 coincides with the shape of the side surface (projection 117) of the pressing member 104 having a cylindrical shape and is formed to be smoothly connected to the pressing member 104 with no step.

In a case where the wiping sheet 101 is pressed against the nozzle surface 37 by the pressing member 104, a material with a smaller hardness has a smaller pressure acting on the nozzle surface than a material with a high hardness. Accordingly, the rotation fixing position of the pressing member 104 is changed so that the pressure acting on the nozzle surface 37 from the wiping sheet 101 can be selectively changed. Therefore, for example, in a case where the nozzle forming portion is further worn and water repellency is deteriorated, by changing the rotation fixing position of the pressing member 104 and pressing the wiping sheet 101 against the nozzle surface 37 by using the projection 117 of the pressing member 104 to wipe the nozzle surface 37, it is possible to sufficiently remove the ink attached to the nozzle forming portion and the non-nozzle forming portion of the nozzle surface 37. On the other hand, in a case where the nozzle forming portion is not worn (for example, when recording head 34 is new), by changing the rotation fixing position of the pressing member 104 and pressing the wiping sheet 101 against the nozzle surface 37 by using the elastic member 119 of the pressing member 104 to wipe the nozzle surface 37, it is possible to remove the ink attached to the nozzle forming portion of the nozzle surface 37 using a weak pressure.

In a case of the pressing member 104 illustrated in FIGS. 12A and 12B, the surface of the pressing member 104 does not have a local recess. Therefore, there is no possibility to lose a function caused by inserting ink and the like into the recess and drying the recess to generate a weak pressure.

As an image forming apparatus such as a printer, a facsimile, a copying machine, a plotter, and a multifunction peripheral having these functions, for example, a liquid discharge recording type image forming apparatus using a recording head to discharge ink droplets (droplets) (inkjet recording apparatus) has been known. Such an inkjet recording apparatus discharges ink droplets on the conveyance object from the nozzle of the recording head and forms an image (recording, printing, transferring, printing are also synonymous, including an action for not only applying an image having meaning such as a character and a figure on a medium but also applying an image with no meaning such as a pattern on a medium (action referred to as droplet discharge and liquid discharge for simply landing droplets on medium), and target includes two-dimensional image and three-dimensional image (stereoscopic image)). A liquid discharge head (liquid droplet discharge head) used as a recording head is a functional component which discharges and sprays liquid from the nozzle. A piezoelectric head which displaces a diaphragm by a piezoelectric actuator and the like and changes a volume in a liquid chamber to increase a pressure to discharge droplets and a thermal head which provides a heating element for generating heat by energization in a liquid chamber and increase a pressure in the liquid chamber by bubbles generated by the heating element to discharge droplets have been known.

In the present application, the material of the "conveyance object" is not limited to paper and includes fabric, leather, metal, plastic, glass, wood, ceramics, and the like. The term "conveyance object" is collectively used for a material referred to as a recording medium, a paper sheet, a recording sheet, and the like to which droplets are attached. Furthermore, the "liquid" discharged from the liquid discharge head is preferably liquid having viscosity and surface tension which can be discharged from the head and is not particularly limited. However, liquid is preferable which has a viscosity which becomes equal to or less than 30 mPa:s under an ordinary temperature and a normal pressure or by being heated or cooled. More specifically, the "liquid" includes a solvent such as water or an organic solvent, solution, suspension liquid, an emulsion, and the like including a coloring agent such as a dye or a pigment, a functionalizing material such as a polymerizable compound, a resin or a surfactant, a biocompatible material such as DNA, an amino acid, a protein, calcium, and the like, an edible material such as a natural colorant, and the like. For example, these kinds of liquid can be used for inkjet ink, surface treatment liquid, liquid for forming a component such as an electronic element and a light emitting element and an electronic circuit resist pattern, material liquid for three-dimensional shaping, and the like. The "liquid discharger" is an assembly of components related to liquid discharge including the liquid discharge head and other functional components and mechanisms integrated together, and includes, for example, at least one of the carriage, the head tank, the liquid supply mechanism, and the maintenance and recovery mechanism. Furthermore, the "liquid discharge apparatus" is a device for driving the liquid discharge head to discharge liquid. The liquid discharge apparatus includes not only a device which can discharge liquid to an object to which liquid can be attached but also a device for discharging liquid towards air and liquid and includes a stereoscopic modeling device, a processing liquid applying device, an injection granulating device, in addition to an image forming apparatus.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A head cleaning device, comprising:

a liquid discharge head including a nozzle, which discharges liquid, on a nozzle surface;

a wiping member to wipe the nozzle surface;

a rotatable pressing member to press the wiping member against the nozzle surface; and a moving assembly to contact the wiping member with the nozzle surface and relatively move the liquid discharge head and the wiping member to perform a wiping operation, wherein the rotatable pressing member includes a recess corresponding to a nozzle forming portion of the nozzle surface on a part of a surface of the rotatable pressing member, and a projection corresponding to a portion of a non-nozzle forming portion of the nozzle surface, and the rotatable pressing member is switchable by rotation, between a first state in which the nozzle forming portion is wiped with the recess and the non-nozzle forming portion is wiped with the projection, and a second state in which both the nozzle forming portion and the non-nozzle forming portion are wiped by the projection.

2. The head cleaning device according to claim 1, wherein a pressure which is generated by the recess of the rotatable pressing member and acts on the nozzle surface from the wiping member is smaller than a pressure which is generated by the projection of the rotatable pressing member and acts on the nozzle surface from the wiping member.

3. The head cleaning device according to claim 1, further comprising a cleaning liquid applicator to apply cleaning liquid to the wiping member.

4. The head cleaning device according to claim 1, wherein the wiping member is impregnated with cleaning liquid before the wiping member is set to the head cleaning device.

5. A liquid discharge apparatus, comprising, the head cleaning device according to claim 1.

6. The head cleaning device of claim 1, wherein the rotatable pressing member further comprises another recess spaced away from the recess in a circumferential direction of the rotatable pressing member.

7. A head cleaning device, comprising:

a liquid discharge head including a nozzle, which discharges liquid, on a nozzle surface;

a wiping member to wipe the nozzle surface;

a rotatable pressing member to press the wiping member against the nozzle surface; and a moving assembly to contact the wiping member with the nozzle surface and relatively move the liquid discharge head and the wiping member to perform a wiping operation, wherein the rotatable pressing member includes a recess corresponding to a nozzle forming portion of the nozzle surface on a part of a surface of the rotatable pressing member, and the head cleaning device further includes circuitry to control a rotation of the rotatable pressing member, and change an angle of the rotatable pressing member according to a degree of wear of the nozzle forming portion.

8. A head cleaning device, comprising:

a liquid discharge head including a nozzle, which discharges liquid, on a nozzle surface;

a wiping member to wipe the nozzle surface;

a rotatable pressing member to press the wiping member against the nozzle surface; and a moving assembly to contact the wiping member with the nozzle surface and relatively move the liquid discharge head and the wiping member to perform a wiping operation, wherein a hardness of a first part of a peripheral surface of the rotatable pressing member corresponding to a nozzle forming portion of the nozzle surface is lower than a hardness of a second part of the peripheral surface corresponding to a non-nozzle forming portion of the nozzle surface, and the rotatable pressing member is switchable by rotation, between a first state in which the nozzle forming portion is wiped with the first part and the non-nozzle forming portion is wiped with the second part, and a second state in which both the nozzle forming portion and the non-nozzle forming portion are wiped by the second part.

9. The head cleaning device according to claim 8, wherein the first part is an elastic member having a hardness smaller than a hardness of a material constituting the second part of the peripheral surface.

10. The head cleaning device according to claim 8, further comprising a cleaning liquid applicator to apply cleaning liquid to the wiping member.

11. The head cleaning device according to claim 8, wherein the wiping member is impregnated with cleaning liquid before the wiping member is set to the head cleaning device.

12. A liquid discharge apparatus, comprising, the head cleaning device according to claim 8.

13. A head cleaning device, comprising:

a liquid discharge head including a nozzle, which discharges liquid, on a nozzle surface;

a wiping member to wipe the nozzle surface;

a rotatable pressing member to press the wiping member against the nozzle surface; and a moving assembly to contact the wiping member with the nozzle surface and relatively move the liquid discharge head and the wiping member to perform a wiping operation, wherein a hardness of a first part of a peripheral surface of the rotatable pressing member corresponding to a nozzle forming portion of the nozzle surface is lower than a hardness of a second part of the peripheral surface corresponding to a non-nozzle forming portion of the nozzle surface, and the head cleaning device further includes circuitry to control a rotation of the rotatable pressing member, and change an angle of the rotatable pressing member according to a degree of wear of the nozzle forming portion.

14. A head cleaning device, comprising:

a liquid discharge head including a nozzle, which discharges liquid, on a nozzle surface;

a wiping member to wipe the nozzle surface;

a rotatable pressing member to press the wiping member against the nozzle surface; and a moving assembly to contact the wiping member with the nozzle surface and relatively move the liquid discharge head and the wiping member to perform a wiping operation, wherein the rotatable pressing member is switchable by rotation between a first state in which a nozzle forming portion of the nozzle surface is wiped with a first pressure, and a second state in which the nozzle forming portion is wiped with a second pressure different from the first pressure.

15. The head cleaning device of claim 14, wherein the rotatable pressing member includes a recess corresponding to the nozzle forming portion, and the recess extends only over a first predetermined range in a circumferential direction of the rotatable pressing member, the first predetermined range being less than 180°.

16. The head cleaning device of claim 15, wherein the recess extends only over a second predetermined range in a longitudinal direction of the rotatable pressing member, the second predetermined range being less than a full longitudinal extent of the rotatable pressing member.

* * * * *